United States Patent [19]

Kincaid

[11] Patent Number: 4,920,233

[45] Date of Patent: Apr. 24, 1990

[54] AUDIO CABLE

[75] Inventor: John W. Kincaid, Batavia, Ill.

[73] Assignee: Cooper Industries, Inc., Houston, Tex.

[21] Appl. No.: 235,297

[22] Filed: Aug. 23, 1988

[51] Int. Cl.[5] ..... H01B 7/34

[52] U.S. Cl. ..... 174/36; 178/45; 333/243

[58] Field of Search ..... 174/36; 178/45; 333/243

[56] References Cited

U.S. PATENT DOCUMENTS

| | | | |
|---|---|---|---|
| 863,247 | 8/1907 | Yeatman | 174/126.2 |
| 1,672,979 | 6/1928 | Fondiller | 174/36 |
| 2,228,798 | 1/1941 | Wassermann | 178/45 |
| 2,787,656 | 4/1957 | Raisbeck et al. | 178/45 |
| 2,929,034 | 3/1960 | Doherty et al. | 333/236 |
| 3,191,132 | 6/1965 | Mayer | 174/36 |
| 3,238,477 | 3/1966 | Brueckmann et al. | 333/243 |
| 3,963,854 | 6/1976 | Fowler | 174/36 |
| 4,079,192 | 3/1978 | Josse et al. | 174/126 CP |
| 4,301,428 | 11/1981 | Mayer | 174/36 X |
| 4,383,225 | 5/1983 | Mayer | 174/36 X |
| 4,515,826 | 5/1985 | Garner et al. | 427/8 |
| 4,587,133 | 5/1986 | Shannon et al. | 427/9 |
| 4,593,153 | 6/1986 | Kuhn et al. | 174/36 X |
| 4,638,272 | 1/1987 | Ive | 178/45 X |
| 4,691,081 | 9/1987 | Gupta et al. | 174/36 X |
| 4,695,127 | 9/1987 | Ohlhaber et al. | 174/70 R X |

OTHER PUBLICATIONS

Mayer, Ferdy, IEEE Transactions On Electromagnetic Compatibility, vol. EMC-28, No. 1, Feb., 1986.

Visser, Leonard J., Belden Innovators, pp. 4-13, Spring 1984.

*Primary Examiner*—Morris H. Nimmo

*Attorney, Agent, or Firm*—Fitch, Even, Tabin & Flannery

[57] ABSTRACT

A cable for use in carrying electrical signals in the audio frequency range. The cable includes an elongate metallic core which can be positioned at the center of the cable. In the case of the coaxial cable, a sleeve of a dielectric material is positioned about the core and a metallic shield is located outwardly of the sleeve and coaxially with the core. The cable also includes a layer formed of ferrite positioned between the sleeve and the shield which substantially increases the inductance of the cable without a corresponding substantial increase in the energy loss so that the cable exhibits substantially constant phase velocity characteristics across the audio frequency band. The ferrite layer can be formed by a series of discrete ferrite sleeves or the ferrite layer might be formed by an extruded thermoplastic having a high loading of ferrite powder. A method of using the cable is also disclosed.

4 Claims, 3 Drawing Sheets

AUDIO CABLE

This invention relates to cables for carrying electrical signals and, more particularly, to a cable for carrying signals in the audio frequency range with a substantially constant velocity of propagation.

BACKGROUND OF THE INVENTION

Commercially available audio cable, used to interconnect audio components such as compact disc players, amplifiers and speakers, transmits different frequency signals within the audio frequency range at different velocities of propagation. The audio frequency range is generally considered to include frequencies from about 15 Hz to about 20 kHz while the radio frequency range is generally considered to extend upwardly from about 150 kHz. Standard audio cable transmits signals near the lower end of the audio frequency range, such as signals resulting from base instruments, at velocities of propagation below about 10% of the speed of light (c). On the other hand, standard audio cable transmits high frequency audio signals, such as one resulting from a violin, at velocities of propagation above about 30% of c. These great differences in the velocities of propagation result in substantial distortion of the output signals.

Various cables, including a metallic core and a surrounding sleeve of magnetically permeable material (such as ferrite), have been proposed for transmission of radio frequency signals to reduce radio frequency attenuation. For further information concerning the structure and operation of such cables, reference may be made to U.S. Pat. Nos. 2,787,656; 3,238,477; 4,079,192; 4,515,826; and 4,587,133.

U.S. Pat. No. 4,695,127 discloses a coaxial cable including a metallic core with a coaxial metallic shield formed by a metallic braid over a metallic foil.

SUMMARY OF THE INVENTION

Among the various aspects and features of the present invention may be noted the provision of an improved cable for transmission of audio frequency signals. The velocity of propagation of various signals in the audio frequency band is nearly constant, varying by only about ten percent. The audio cable is flexible so that it can easily be twisted or otherwise bent. Additionally, the audio cable of the present invention has long service life, is reliable in use, and is relatively easy and economical to manufacture. Other aspects and features of the present invention will be, in part, apparent and, in part, pointed out specifically hereafter in the following specification and drawings.

Briefly, a coaxial cable embodying various aspects of the subject invention has an elongate metallic core positioned at the center of the cable with a sleeve of a dielectric material surrounding the core. A metallic shield is located outwardly of the sleeve and coaxial therewith. The cable also includes a layer formed of ferrite positioned between the sleeve and the shield so that the layer of ferrite substantially increases the inductance of the cable without a substantial corresponding increase in energy loss so that the cable exhibits substantially constant phase velocity characteristics across the audio frequency band. The layer could be formed by a series of ferrite sleeves or the layer could be formed by an extruded thermoplastic with a high loading of ferrite powder.

As a method of using the cable, the invention includes the following steps:

A. A first audio component is connected to a second audio component using the cable; and B. Signals in the audio frequency range are sent over the cable from the first component to the second component so that signals of different frequencies within the audio frequency range have substantially the same velocity of propagation.

BRIEF DESCRIPTION OF THE DRAWINGS

Corresponding reference characters indicate corresponding components throughout the several views of the drawings.

DESCRIPTION OF THE PREFERRED EMBODIMENTS

Figure 1:
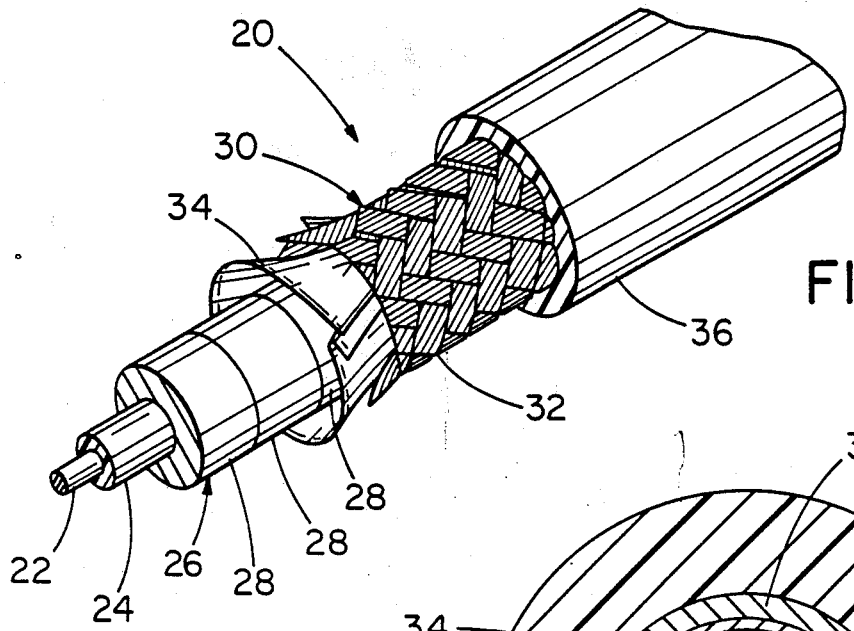
FIG. 1 illustrates, in an enlarged scale, a length of one preferred embodiment of the audio cable of the present invention with certain components of the cable removed to expose underlying layers and elements, with a ferrite layer formed of axially spaced discrete sleeves.
Figure 2:
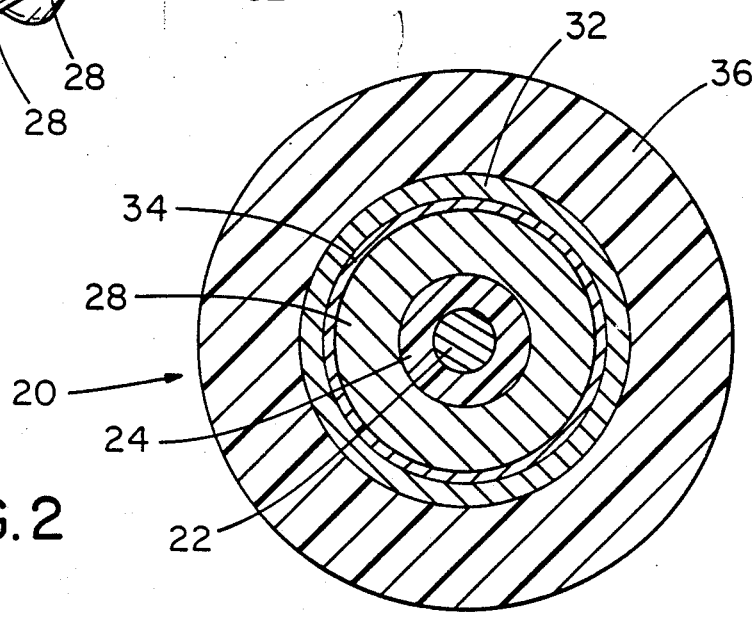
FIG. 2 is a transverse cross-sectional view of the audio cable of FIG. 1.

Referring now to the drawings, an audio cable embodying various aspects of the present invention is indicated in FIGS. 1 and 2 by reference numeral 20. The coaxial cable 20, which can carry electrical signals in the audio frequency range with substantially constant velocity of propagation throughout the range, includes an elongate metallic core 22 at the center of the cable. The core 22 is preferably of copper or aluminum. A sleeve 24 of a dielectric, which may be polyethylene, surrounds the core. Positioned about sleeve 24 is a layer 26 formed of a series of axially spaced ferrite sleeves 28 or toroids. The ferrite layer 26 is in turn encompassed by a metallic shield 30 coaxial with the core 22. The shield 30 preferably includes a metallic braid 32 disposed over and in contact with a metallic foil 34. The braid functions to limit penetration of low frequency noise while the presence of the foil limits high frequency noise penetration. The cable 20 also includes a protective outer jacket 36 preferably formed of a tough abrasion resistant thermoplastic material such as PVC.

The presence of the ferrite layer 26 functions to greatly increase the inductance of the transmission line formed by the cable without an accompanying increase in energy losses in the cable which could result in unacceptable signal attenuation. The layer 26 can increase the inductance by a hundredfold over standard audio cables. Each ferrite sleeve could have an inside diameter of about 0.125 inch and an outside diameter of about 0.250 inch.

It will be appreciated that all components of cable 20, except the ferrite, are flexible. The use of the discrete, axially spaced ferrite sleeves permits bending of the cable between adjacent sleeves thereby rendering the overall cable flexible.

Figure 3:
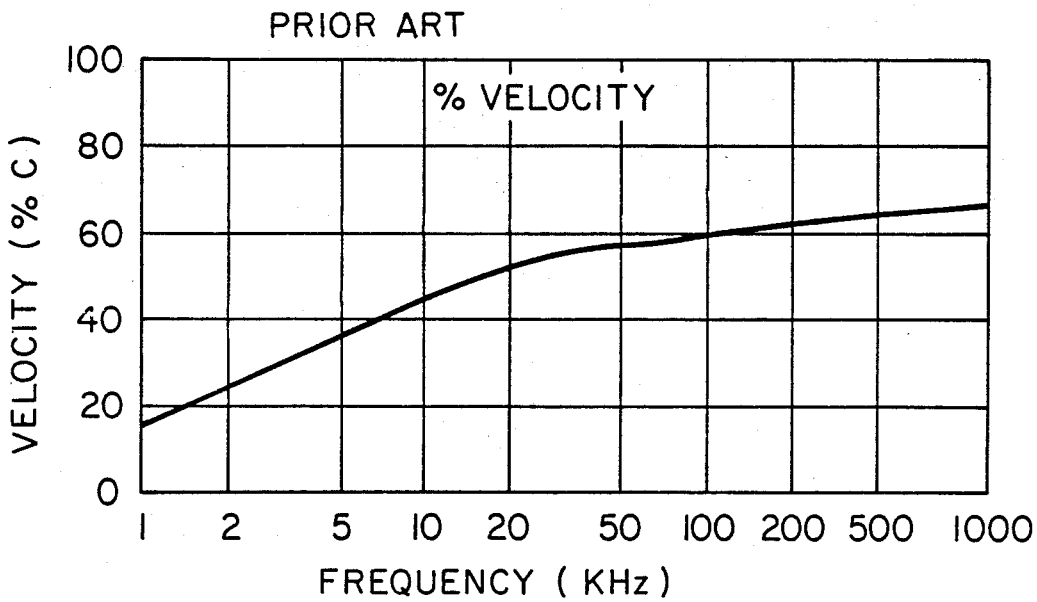
FIG. 3 is a graph illustrating velocity of propagation (as a percent of the speed of light) versus frequency (kHz) for a prior art audio cable.

Referring to the graph of FIG. 3, the velocities of propagation are shown for various frequencies in the audio band for an exemplary standard audio coaxial cable, Belden Part No. 9269 RG-62 A/V. FIG. 3 indicates that the velocity of propagation increases from about 15% C at 1 kHz to about 55% C at 20 kHz, an increase of over 300%.

Figure 4:
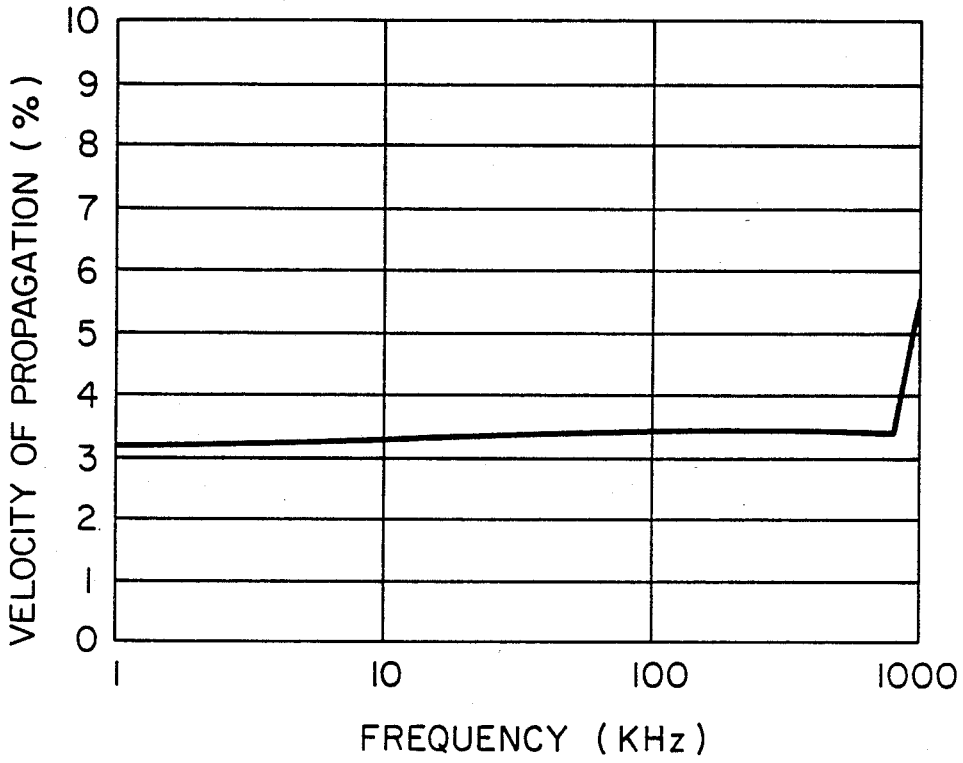
FIG. 4 is a graph illustrating velocity of propagation versus frequency for the audio cable of the present invention.

The graph of FIG. 4 shows the velocities of propagation for various frequencies in the audio band for the coaxial cable 20 loaded with the ferrite sleeves 28. At 1 kHz, the velocity of propagation is about 3.2% c while at 20 kHz the velocity of propagation is only about 3.4% c, an increase of only about 6%. Thus while the velocity of propagation is slower for cable 20 than for the prior art cable, cable 20 has a substantially constant velocity of propagation across the audio frequency band, resulting in a purer, more faithfully reproduced audio sound.

Figure 5:
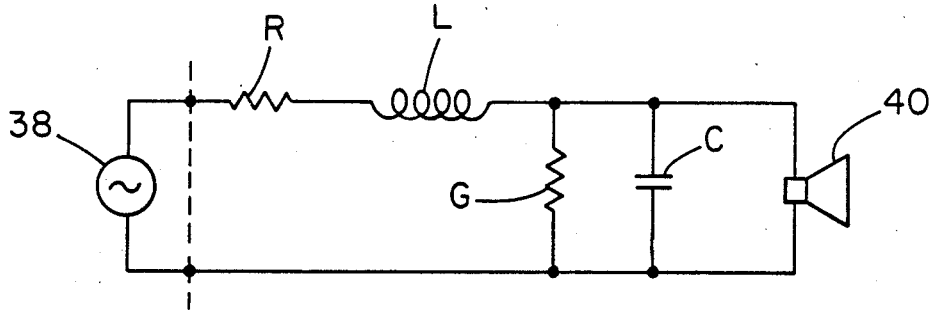
FIG. 5 is an electrical schematic diagram of an equivalent circuit of the cable of FIG. 1.

Referring to FIG. 5, an equivalent circuit of the cable 20 is shown interconnecting a pair of audio components such as an amplifier 38 and a speaker 40. The circuit diagram shows resistive (R), inductive (L), conductive (G), and capacitance (C) components lumped into single components. The velocity of propagation Vp is related to the phase constant:

$$Vp=\omega/\beta \tag{1}$$

where $$\omega=2\pi f \text{ and} \tag{2}$$

Where $$\beta=\{\tfrac{1}{2}[\sqrt{(R^2+\omega^2L^2)(G^2+\omega^2C^2)}+\omega^2LC-RG]\}^{\frac{1}{2}} \tag{3}$$

In the standard audio cable at low frequencies (in the 1 kHz range), the inductance is small and the product of frequency and inductance is much less than line resistance. Additionally, the conductance is small compared to the product of frequency and capacitance. These inequalities are the basic reasons why velocity of propagation normally varies as a function of the square root of frequency in a standard audio cale. The approximation, from equation (3), good for a standard audio cable at low frequencies is $$Vp=\sqrt{4\pi f/RC} \tag{4}$$

This equation demonstrates that resistance, R, and capacitance, C, as well as frequency, f, determine what the velocity, Vp, will be. Low resistance cables and those with low capacitance will exhibit higher velocity than cables with higher values of resistance or capacitance. Such high velocity cables may seem to perform better in some music applications than the lower velocity cables. However, both cables will produce phase distortion because different frequencies in the music will travel along the cable at different velocities.

In the cable 20 of the present invention loaded with the ferrite sleeves, the inductance is relatively large. The inductance is sufficiently large to cause the product of frequency and inductance to be much greater than the resistance. This inequallity, which is valid at audio frequencies, is similar to the transmission line relationships which are valid for unloaded cables at radio frequencies. The well known high frequency formula, also derived from equation (3), $$Vp=1/\sqrt{LC} \tag{5}$$

shows that at audio frequencies the velocity is determined approximately by inductance and capacitance. The velocity is not substantially dependent on frequency. Toroid loaded music cable will not produce significant phase distortion.

As a method of using the audio cable 20, the present invention includes the following steps:

A. A first audio component 38 is connected to a second audio component 40 using the cable; and B. Signals in the audio frequency range are transmitted over the cable from the first component to the second component so that signals of different frequencies within the audio frequency band have substantially the same velocity of propagation.

Figure 6:
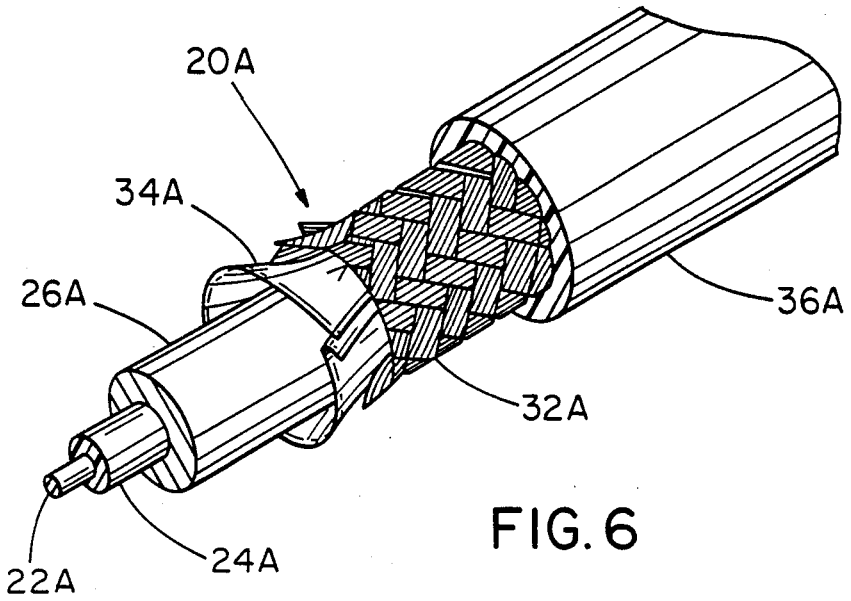
FIG. 6, similar to FIG. 1, shows an alternate embodiment of the audio cable of the present invention with the ferrite layer formed by an extruded thermoplastic material loaded with ferrite powder.

An alternative preferred embodiment of an audio cable embodying various features of the present invention is shown in FIG. 6 by reference character 20A. Components of cable 20A corresponding to cable 20 are identified by the reference numerical assigned to the component of cable 20 with the addition of the suffix "A". In audio cable 20A, the ferrite layer 26A is formed by extruding a thermoplastic material loaded with ferrite powder. The ferrite powder preferably makes up, by weight, eighty to ninety percent of the layer 26A. The ferrite layer 26A also functions to increase the inductance of the cable sufficiently so that there is a nearly constant velocity of propagation across the audio frequency range.

Figure 7:
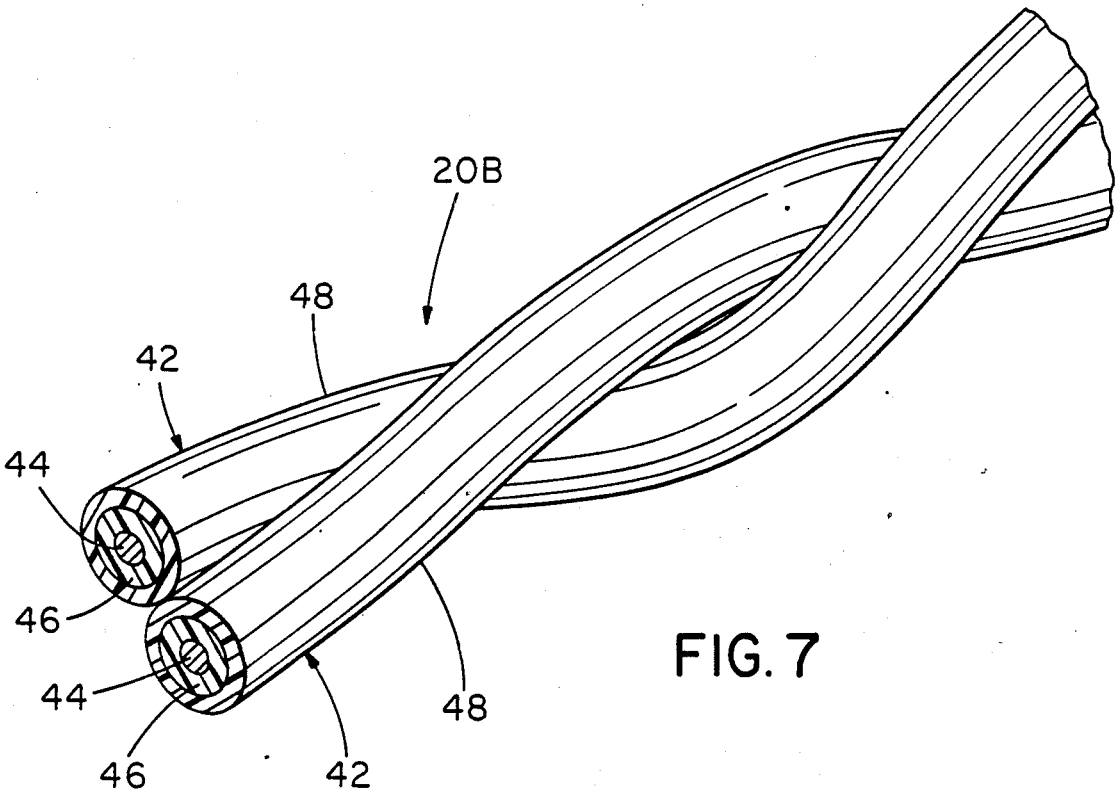
FIG. 7 is a greatly enlarged perspective view of another preferred embodiment of the audio cable of the present invention comprising a twisted pair of conductors.

Referring to FIG. 7, another alternative embodiment of an audio frequency cable embodying various aspects of the present invention is shown by reference character 20B. Cables 20B includes at least one pair of elongate conductors 42 twisted about each other to reduce crosstalk, as is well known to those skilled in the art. Each of the conductors 42 includes an elongate metallic core 44 with a layer 46 comprising ferrite encompassing the core. Each conductor 42 also includes an outer jacket 48 of insulating material. The ferrite layer 46, which could be made up of axially spaced ferrite sleeves or by an extruded thermoplastic loaded with ferrite powder, includes a sufficient amount of ferrite to substantially increase the inductance of the cable so that signals of different frequencies in the audio frequency range have a substantially constant velocity of propagation in the cable. It will be appreciated that the audio cables 20A and 20B are also very flexible to permit ease of bending and, in the case of cables 20B, twisting.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A coaxial cable for use in carrying electrical signals in the audio frequency range, said cable comprising:

a relatively flexible elongate metallic core disposed at the center of said cable;

a relatively flexible sleeve of a dielectric material positioned about said core;

a relatively flexible metallic shield disposed outwardly of said sleeve and coaxial with said core; and a layer formed of ferrite positioned between said sleeve and said shield, said layer being in contact with the dielectric sleeve substantially throughout the length of said cable, said layer being made up of a series of axially aligned ferrite sleeves, each of said ferrite sleeves being relatively rigid, whereby the layer of ferrite substantially increases the inductance of the cable without a concomitant substantial increase in energy loss so that the cable exhibits substantially constant phase velocity characteristics across the audio frequency band.

2. A coaxial cable as set forth in claim 1 comprising an outer jacket of insulating material.

3. A coaxial cable as set forth in claim 1 wherein said shield comprises a layer of metallic foil and a metallic braid.

4. A coaxial cable as set forth in claim 3 wherein said layer of foil is positioned under the braid and in contact therewith.

* * * * *

UNITED STATES PATENT AND TRADEMARK OFFICE

CERTIFICATE OF CORRECTION

PATENT NO. : 4,920,233

DATED : April 24, 1990

INVENTOR(S) : John W. Kincaid

It is certified that error appears in the above-identified patent and that said Letters Patent is hereby corrected as shown below:

Column 3, line 50, change "cale" to --cable--.

Column 4, line 2, change "inequallity" to --inequality--.

Column 4, line 30, insert another space after "A".

Column 4, line 41, change "Cables" to --Cable--.

Column 4, line 56, change "cables" to --cable--.

Signed and Sealed this

Twenty-third Day of July, 1991

*Attest:*

*Attesting Officer*

HARRY F. MANBECK, JR.

*Commissioner of Patents and Trademarks*